US008358188B2

(12) United States Patent
Bellotto et al.

(10) Patent No.: US 8,358,188 B2
(45) Date of Patent: Jan. 22, 2013

(54) ELECTRONIC TRIP DEVICE CASE FOR A CIRCUIT BREAKER, ELECTRONIC TRIP DEVICE AND ASSEMBLY METHOD THEREOF

(75) Inventors: Henri Bellotto, Saint Martin d'Heres (FR); Frédéric Toti Buttin, Le Pont de Claix (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 747 days.

(21) Appl. No.: 12/318,729

(22) Filed: Jan. 7, 2009

(65) Prior Publication Data

US 2009/0190289 A1 Jul. 30, 2009

(30) Foreign Application Priority Data

Jan. 10, 2008 (FR) ..... 08 00130
Jan. 10, 2008 (FR) ..... 08 00131

(51) Int. Cl.
*H01H 9/02* (2006.01)
*H01H 13/04* (2006.01)

(52) U.S. Cl. ..... 335/202

(58) Field of Classification Search ..... 335/8, 202, 335/169

See application file for complete search history.

(56) References Cited

U.S. PATENT DOCUMENTS

| | | | | |
|---|---|---|---|---|
| 4,300,110 | A | 11/1981 | Bayer et al. | 335/6 |
| 4,870,531 | A | 9/1989 | Danek | 361/93 |
| 5,093,643 | A * | 3/1992 | Altenhof et al. | 335/20 |
| 5,379,013 | A | 1/1995 | Coudert | 335/17 |
| 6,191,947 | B1 | 2/2001 | Titus et al. | 361/726 |
| 6,201,460 | B1 * | 3/2001 | Winslett et al. | 335/172 |
| 6,406,328 | B1 | 6/2002 | Attarian et al. | 439/502 |
| 6,482,048 | B1 | 11/2002 | Fleege et al. | 439/801 |
| 6,784,770 | B2 * | 8/2004 | Gimenez et al. | 335/18 |
| 7,598,834 | B2 * | 10/2009 | Whitaker et al. | 335/202 |
| 7,645,953 | B2 * | 1/2010 | Bogdon et al. | 200/293 |
| 7,800,468 | B2 * | 9/2010 | Bogdon et al. | 335/202 |
| 7,829,808 | B2 * | 11/2010 | Bogdon et al. | 200/293 |
| 7,961,480 | B2 * | 6/2011 | Besana et al. | 361/837 |
| 2003/0048589 | A1 | 3/2003 | Tignor et al. | 361/93.3 |
| 2005/0024173 | A1 | 2/2005 | Puskar et al. | 335/172 |
| 2005/0253573 | A1 | 11/2005 | Budillon et al. | 324/126 |
| 2006/0136567 | A1 | 6/2006 | Muramatsu et al. | 709/217 |
| 2006/0171774 | A1 | 8/2006 | Chaumette et al. | 403/41 |

FOREIGN PATENT DOCUMENTS

| | | |
|---|---|---|
| DE | 27 17 417 | 10/1978 |
| DE | 299 17 174 | 1/2000 |
| EP | 0 609 898 | 2/1994 |
| EP | 1 113 476 | 7/2001 |
| FR | 2 701 335 | 8/1994 |
| FR | 2 840 373 | 12/2003 |
| FR | 2 893 445 | 11/2005 |
| FR | 2 907 265 | 4/2008 |
| FR | 2 913 143 | 8/2008 |

* cited by examiner

*Primary Examiner* — Elvin G Enad
*Assistant Examiner* — Alexander Talpalatski
(74) *Attorney, Agent, or Firm* — Steptoe & Johnson LLP

(57) ABSTRACT

An electronic module for a trip device has been optimised so as to integrate the known functionalities, in particular threshold parameter setting, current measurements, voltage taps, read-out display and communication. An electromagnetic actuator is further present in the electronic module to optimise breaking of the associated circuit breaker. The space occupation constraints inherent to location of the trip device in existing switchgear units have been respected.

29 Claims, 11 Drawing Sheets

ELECTRONIC TRIP DEVICE CASE FOR A CIRCUIT BREAKER, ELECTRONIC TRIP DEVICE AND ASSEMBLY METHOD THEREOF

TECHNICAL FIELD

The invention relates to tripping of switchgear apparatuses by means of electronic processing. The invention relates more particularly to an electronic trip device able to be integrated in existing switchgear apparatuses and which acts on the contacts of the latter by means of an integrated electromagnetic actuator. An electronic module of the trip device can further comprise known functionalities, in particular threshold parameter setting, current measurements, test connector, display and communication functions.

The invention also relates to a case for an electronic trip device having a design that has been optimized for maximum compactness. The invention also relates to the trip device and the assembly method thereof which is simplified in spite of the density of integrated functionalities.

STATE OF THE ART

As illustrated in the document FR 2 696 275 and represented schematically in FIG. 1, a moulded case circuit breaker 1 comprises a trip device 2 enabling the contacts of the switchgear unit 3 to be actuated in timely manner. The overall dimensions of circuit breaker 1 are more or less standardized, defined by the range of switchgear units 3 and, in particular, trip device 2 is fitted in a housing 4 arranged in the case of said unit 3.

Different trip units are known, with in particular the development of electronic trip devices 2 which, compared with magnetic or thermal-magnetic trip devices, enable for example the current thresholds causing breaking to be adjusted by suitable means 5 and checks to be made by means of a test connector 6. Typically, an electronic trip device 2 comprises a case 7 made from insulating material in which a processing unit of the printed circuit board type is housed, receiving signals indicative of the distribution circuit. When the value of the current signals exceeds preset thresholds for preset time periods, the processing unit sends a signal to an actuating device 3, such as a solenoid, which separates the pairs of contacts of circuit breaker 1.

The trip devices 2 are generally removable and are fitted in the case of circuit breaker 1 only when installation of the latter is performed. It is moreover usual for trip devices 2 to be interchangeable to satisfy the variety of demand, ranging from basic protection to the most advanced protection, comprising multiple setting points and/or different measuring functions such as voltage, power and/or energy measurement. Furthermore, it may be desirable to replace a trip device 2 on an existing switchgear unit 1, in case of malfunctioning or in order to add new functions. Although the functionalities of a trip device 2 and the parameters to be set 5 may be consequent in number, dimensioning of the trip units 2 is therefore subjected to strict criteria relating to their housing 4.

The use of microprocessors should indeed enable all the protection functions to be accommodated in cases 7 of small dimensions. However, the space requirements inherent to these functionalities cannot be minimized at will, in particular on account of the constraints generated by the connections between the different component elements performing processing, measuring, parameter setting and actuation. The usual wires, solders or contact blades impose a compromise among the functions integrated in trip unit 2, the others then being able to be performed by external auxiliary units connected by means of hard-wired connections. In particular, the contact actuation system does not form part of electronic trip device 2.

In spite of the various designs, such as for example that described in the document EP 0 991 095, electronic trip devices are therefore not optimised and require connection of auxiliaries, thereby making the circuit breaker assembly procedure more cumbersome.

SUMMARY OF THE INVENTION

Among other advantages, the object of the invention is to palliate the shortcomings of existing electronic trip units and to propose a trip device having a design that enables the different component elements necessary for performing the required functionalities to be included. In particular, the trip device according to the invention complies with the space occupation constraints and can replace a trip unit, in particular a magnetic or thermal trip unit, in an existing circuit breaker. Furthermore, the trip device according to the invention integrates both the electromagnetic actuation device of the circuit breaker contacts and measurement and processing of the different values representative of the current flowing in the distribution circuit, and also the means enabling the user to set the tripping threshold parameter values. Assembly thereof is thereby facilitated. In addition, as the architecture is common to the different circuit breakers whatever the number of poles or the breaking intensity of the latter, assembly and storage of the different components are rationalised.

According to one feature, the invention relates to an electronic trip device that can be connected to a switchgear unit by connecting strips. The invention also relates to the electronic module of such a device and to its case.

The case of the module thus comprises a bottom part and a cover which fits onto and around the bottom part to form a cavity, preferably by clipping, in which cavity a printed circuit board is housed. The cover presents holes for operating auxiliaries such as extension parts of thumb-wheels of the printed circuit board and a test connector. Its external surface can also comprise a recess for fitting a display read-out.

In the bottom part of the case according to the invention, a sheath is provided for housing an actuator in tight manner with respect to the cavity surrounding same, the actuator being able to take an inactive position and an active position in which it is protruding from the case orthogonally to the side panel facing the connecting strips of the trip device in order to actuate the circuit breaker contacts. The sheath opens out onto the side panels of the case via a passage for connection of the actuator and via a hole enabling the actuator to take its active position. Preferably, a mobile striker is securedly affixed to the cover and driven by the actuator when moving from the inactive position to the active position. In the module and the trip device according to the invention, the actuator placed in the sheath is preferably an electromagnetic actuating device comprising a push-rod sliding out of the sheath and a connector passing via the connection passage.

The electronic module also preferably comprises a printed circuit board in the cavity of the case, a board whereto the connector of the actuator is connected, preferably via the edge thereof, and advantageously by means of a localised connection between the side panels of the cover and the bottom part. The connections with a transformer unit to form an electronic trip device are preferably also made via the edge and between the walls of the bottom part and the cover of the case according to the invention. This solution increases the compactness of the device and prevents any action which might result in incorrect positioning and/or damage to the connecting wires. Said transformer unit and the electronic module are preferably secured to one another by clipping so as to eliminate any screw or other non-captive securing means.

According to a preferred embodiment of the invention, the electronic module comprises other functionalities than protection by tripping following analysis of the currents, and the interfaces for activating these functionalities are advantageously developed on an additional printed circuit board fitted in the cavity of its case. Each of the additional printed circuit boards is preferably at least partially superposed on the main board, and data transfer takes place by means of non-wired orthogonal connectors. The connectors between the boards are advantageously in the form of spring contacts or gold-plated pistons which enable any defects caused by coplanar stacking to be compensated. The module can in particular comprise a board presenting an interface towards the outside, the case then being provided with a suitable arrangement, for example being L-shaped.

Advantageously, the electronic module according to the invention comprises a direct processing unit of the voltage values, and possibly that of the neutral, which data it transfers to the main printed circuit board. The board dedicated to this processing is preferably fitted in the cavity of the case with a dielectric shield that is either moulded or moulded from a casting, insulating this board from the rest of the electronic components. The case is then moreover arranged such as to tap the voltage directly. In particular, the bottom part of the case can be made in two parts, with a bottom and a double bottom joined to one another, preferably by welding, to form an insulated space in which means can be positioned enabling the value of the voltages and of the neutral to be tapped. In particular, arrangements of chicane type can define paths in which conductors are placed comprising a first strip connecting e.g. with the connecting strips of the transformer unit, and a second strip internal to the cavity. A hole in the bottom at the level of these second strips enables a contact, preferably a gold-plated piston, to transmit data to the insulated processing printed circuit located opposite the hole.

The case and the electronic module according to the invention can comprise other functionalities. For example, a sliding device can be fitted between the bottom and the double bottom of the case to communicate an outside push. Contact-free connecting means can also be provided, with an optic passage arranged in the case, preferably at the level of means for securing with another unit also provided with optic communication means. When said unit is secured, for example by clipping onto a rail, the communication means can transmit their data via said optic passage.

The case and the electronic module according to the invention are suitable for trip devices of any rating, and for any number of poles, in particular three or four. The trip device can be fitted in the case of a switchgear unit, also an object of the invention, in order to trigger separation of the contacts thereof. For this purpose, the trip device according to a preferred embodiment of the invention is associated with an alignment of breakable screws of the comb connector type so that fitting in a circuit breaker arrangement is achieved by connecting each of the comb connector screws on the connecting strips, tightening, and sectioning of the screws, the residual part whereof remains connected to an assembly of consequent size. This makes for ease of assembly guaranteeing uniformity of the tightening torques.

According to another feature, the invention refers to the method for assembling an electronic trip device whose geometry is optimised to incorporate all the functions, in particular actuation. A bottom part of the electronic module case comprises a cavity in which a sheath is located opening out onto a hole on two opposite side panels. In a preferred embodiment, the bottom part is achieved by welding a bottom onto a double bottom, and by locating conductors between the latter enabling a voltage and/or neutral tap to be made, or even other elements of pusher type. A preferably electromagnetic actuator is fitted in the sheath of the bottom part, with its connector passing through one of the holes and the sliding part of the actuator able to be protruding via the other hole.

The method according to the invention is continued by securing the bottom part onto the transformer unit of the trip device, preferably by clipping. In particular, to reduce heating, the primary conductor of the transformer unit is composed of two parts only, welded or otherwise securedly affixed via one end at the level of a loop passing twice in the magnetic circuit. To enable each part of the conductor to pass in the centre of the magnetic circuit, at least one of the parts is not completely folded at the level of its ends. In particular, the last angle between two sides of the loop is obtuse, and it is closed to 90° once fitted around the case of the transformation element so as to operate in conjunction with an end of the other part to be welded.

The printed circuit boards are then fitted in the cavity, with partial stacking and direct connection due to the orthogonal contacts which advantageously act as springs. The connectors of the actuator and of the transformer unit are secured to the main printed circuit board by brazing, preferably on the edge. The cavity is closed by a cover that is fitted parallel to the main printed circuit board, preferably by clipping. Actuating means of the board are coupled to the cover, preferably by clipping after the cover has closed off the cavity. Other elements such as a display read-out can also be assembled. The trip device thus assembled can be fitted in a switchgear unit.

BRIEF DESCRIPTION OF THE DRAWINGS

Other advantages and features will become more clearly apparent from the following description of particular embodiments of the invention, given for illustrative and in no way non-restrictive purposes only, represented in the accompanying drawings.

DETAILED DESCRIPTION OF A PREFERRED EMBODIMENT

The invention will be described hereinafter according to a preferred embodiment comprising options of the trip device 200 which can be omitted if required. Alternatives will be clearly apparent to the person skilled in the art, and the different components enumerated should not be construed as being indispensable to the object for which protection is sought for. To lighten the figures, some of these elements, optional for the object of the invention, will not be included in all the graphic representations.

Figure 1:
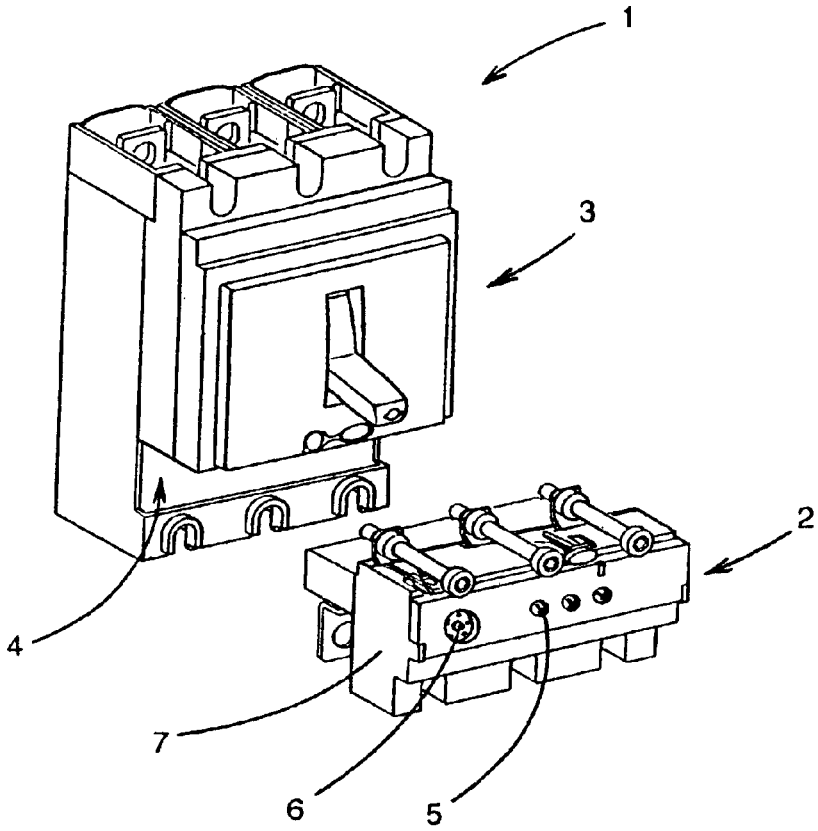
FIG. 1, already described, represents a switchgear unit in which a trip device according to the invention can be fitted.

Moreover, the trip device according to the invention can be fitted on the different existing "moulded case" switchgear units, operating in particular between 16 and 630 A, whatever the number of poles concerned, even if the embodiment presented concerns an electronic trip device for a three-pole circuit breaker 1 as illustrated in FIG. 1, i.e. comprising three pairs of contacts to interrupt the current in each of the three phases.

Finally, for the sake of simplification of presentation of a preferred embodiment of the invention, trip device 200 will be described in relation to the assembly/fitting position in which circuit breaker 1 is placed flat, with recess 4 of the case facing upwards, i.e. the surface of trip device 200 accessible to the user and equipped with the setting adjustment means is at the top, substantially horizontal. The use of relative position terms such as "side", "top", "bottom" etc., should not be interpreted as being a limiting factor.

As usual, a trip device 200 defines an external enclosure inserted in a recess 4 of the case of circuit breaker 1, the (outer) top surface whereof is provided with setting and display elements accessible to the user. According to the invention, the enclosure of trip device 200 is delineated by assembly of an electronic processing module with a current transformer unit 10, which can be of conventional design. In particular, as illustrated in FIG. 2E, transformer unit 10 comprises a case 12 having a shape to suit recess 4 of switchgear unit 3 and/or of circuit breaker 1 wherein it is to be fitted. Case 12 of transformer unit 10 houses a conductor for each phase of the distribution circuit associated with a mixed current sensor, such as described for example in FIG. 10 of the document FR 2 870 350. The data obtained by the sensor and also a supply current are transmitted to the electronic processing module by a suitable connector 14. Preferably, according to the invention, on account of the compactness of the trip device, connectors 14 are flexible and associated with connecting means 15 of very short wired type. Advantageously, connectors 14 are suitable for edge-wise connection of a printed circuit board, such as described for example in the document FR 2 913 143. In particular, transformer unit 10 of a trip device according to the invention is as described in French patent application FR 08 00131, the priority of which is claimed.

In particular, transformer unit 10 comprises a plurality of transformation elements $\mathbf{10}_i$ each with a primary conductor 17 designed to be connected to the power supply line via one end 18 and to connect with a switchgear device 3 via the other end 16, the two strips preferably being parallel to one another. The magnetic circuit of preferred transformation elements $\mathbf{10}_i$ is rectangular in shape for ease of assembly with switchgear device 3 and electronic module 200. The magnetic circuit and the secondary winding are fitted in an insulating case 12 of suitable shape, substantially that of a rectangular parallelogram, provided with a passage through which primary conductor 17 passes. To obtain a signal representative of the current after transformation, primary conductor 17 preferably passes through the magnetic circuit twice, forming a substantially rectangular loop with two portions that are coplanar in the passage and separated by a sufficient space to ensure insulation or for an additional insulating shield to be fitted. Furthermore, conductor 17 is rigid over the whole length thereof so as to maintain the position of the loop around the magnetic circuit, which means that conductor 17 has to be formed in several parts which it is recommended to weld.

Figure 5:
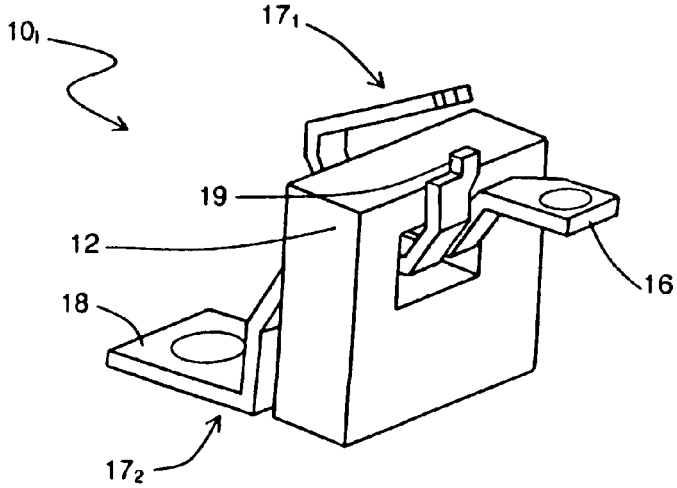
FIG. 5 shows assembly of the primary conductor of a transformer element according to an embodiment of the invention.

Advantageously, to reduce heating due to the high resistance of a weld, each conductor 17 of unit 10 is manufactured in two parts $\mathbf{17}_1$, $\mathbf{17}_2$ each comprising one of the end strips 16, 18. Reducing the number of welding points is moreover advantageous as far as time and manufacturing cost are concerned, while at the same time increasing reliability. Although it is rigid, at least one of the parts $\mathbf{17}_1$ of conductor does not have its final shape before it is inserted in the passage. However, to enable a rigid conductor to be "deformed" around a moulded plastic case 12, each of the parts $\mathbf{17}_i$ is made of metal folded substantially into the final shape. In particular, as illustrated in FIG. 5, only the terminal portion at the level of the junction point 19 of the first part $\mathbf{17}_1$ moves away from its final position with an opening angle of more than 90°, which is recommended for the loop so that said part $\mathbf{17}_1$ can be inserted in the passage. Securing means of grip type then exert pressure on the insufficiently folded part to close the loop, modifying the angle concerned to achieve the final shape.

In some configurations, in particular to position the junction point 19 at the most suitable place for the fitter and/or if the output terminal strip 16 cannot pass through the passage of case 12, it is possible for both of the two parts $\mathbf{17}_i$ not to be made in their final configurations and for two deformations to be performed closing the terminal angle between two portions around the magnetic circuit case 12.

The three conductors of the three-pole transformer unit 10 open out onto a side panel of case 12 via three connecting strips $\mathbf{16}_1$, $\mathbf{16}_2$, $\mathbf{16}_3$ substantially forming a plane and provided with connecting holes, which will be connected to the three current input terminal strips of switchgear device 3 of circuit breaker 1. On the lateral face opposite case 12, each conductor opens out via a terminal strip 18 enabling connection to the external circuit. The presence of the measuring and power supply transformers of transformer unit 10 impose a notable size constraint on the unit. This element therefore occupies a large part of recess 4 of the case of circuit breaker 1, which part is incompressible.

The electronic processing module of trip device 200 according to the invention therefore has to be integrated in the residual space of recess 4 of the circuit breaker. In particular, for a three-pole circuit breaker 1 of 100 A, respectively 630 A, the size of trip device 200 (length×width×depth in the assembled position of circuit breaker 1) is about 100×25×48 $mm^3$, respectively 130×45×65 $mm^3$. For a four-pole circuit breaker, often only one dimension is increased, for a respective length of 135 and 175 mm. The transformer unit 10 conventionally occupies 60% of the depth, only leaving less than 20 or 30 mm for the electronic processing module case 20.

The electronic module of a trip device 200 (FIG. 2H) comprises a case 20 according to the invention housing the different elements necessary for processing tripping information. Its shape matches recess 4 to be filled, and its bottom surface can be juxtaposed on the substantially rectangular top surface of case 12 of transformer unit 10. Case 20 of the electronic module is formed by a first bottom part 22 on which the different elements making up the module are positioned and which fits on transformer unit 10, and a second part forming a cover 24 which protects the different components of the module (FIG. 2G). Preferably, to simplify assembly, bottom part 22/34 comprises first side panels 26 substantially orthogonal to the first surface of case 20 fitted on transformer unit 10, thereby defining a cavity 28 in which the different components are assembled (FIGS. 2C-24 and the cover 24 (FIG. 2G) also comprises second end panels 26' defining a cavity 28' of larger size than bottom part 22. Cover 24 therefore overlaps on bottom part 22.

According to a preferred embodiment of the invention and as illustrated in FIG. 2, in addition to the part extending transformer unit 10 and enabling processing of the data provided by the latter, case 20 of the electronic module comprises an additional compartment in particular for communication to the outside and for additional connections. The additional compartment is preferably offset with respect to the overhanging main part of transformer unit 10, so that the electronic module comprises a substantially L-shaped case 20. The additional compartment is formed in continuous manner with the rest of the case, with the bottom part 22, as is cover 24, in the shape of an L, with a substantially rectangular main cavity 28A extended by an orthogonal cavity 28B which may communicate with one another only via a restricted passage.

In the preferred embodiment of the invention, as a supplement to the current value communicated by connectors 14 of transformer unit 10, electronic trip device 200 makes use of the value of the voltage flowing in each phase of the electric circuit. This type of phase voltage measurement implies insulation constraints of the means 30 used which, according to the invention, are thus integrated in the electronic module, or more exactly in the bottom part 22 of its case 20. The bottom part 22 is for this purpose composed of a double bottom 32 and a bottom 34 that are secured to one another and between which the conductors 30 associated with the voltage measuring function are positioned (FIG. 2C).

Voltage tap conductors $\mathbf{30}_1$, $\mathbf{30}_2$, $\mathbf{30}_3$ present a first end $\mathbf{36}_1$, $\mathbf{36}_2$, $\mathbf{36}_3$ designed to operate in conjunction with the connecting strips of switchgear unit 3 and/or with connecting strips $\mathbf{16}_1$, $\mathbf{16}_2$, $\mathbf{16}_3$ of transformer unit 10, being in contact or directly above the latter in the assembled position, and a second end strip $\mathbf{38}_1$, $\mathbf{38}_2$, $\mathbf{38}_3$ for connection of the voltage measuring means.

Figure 2A:
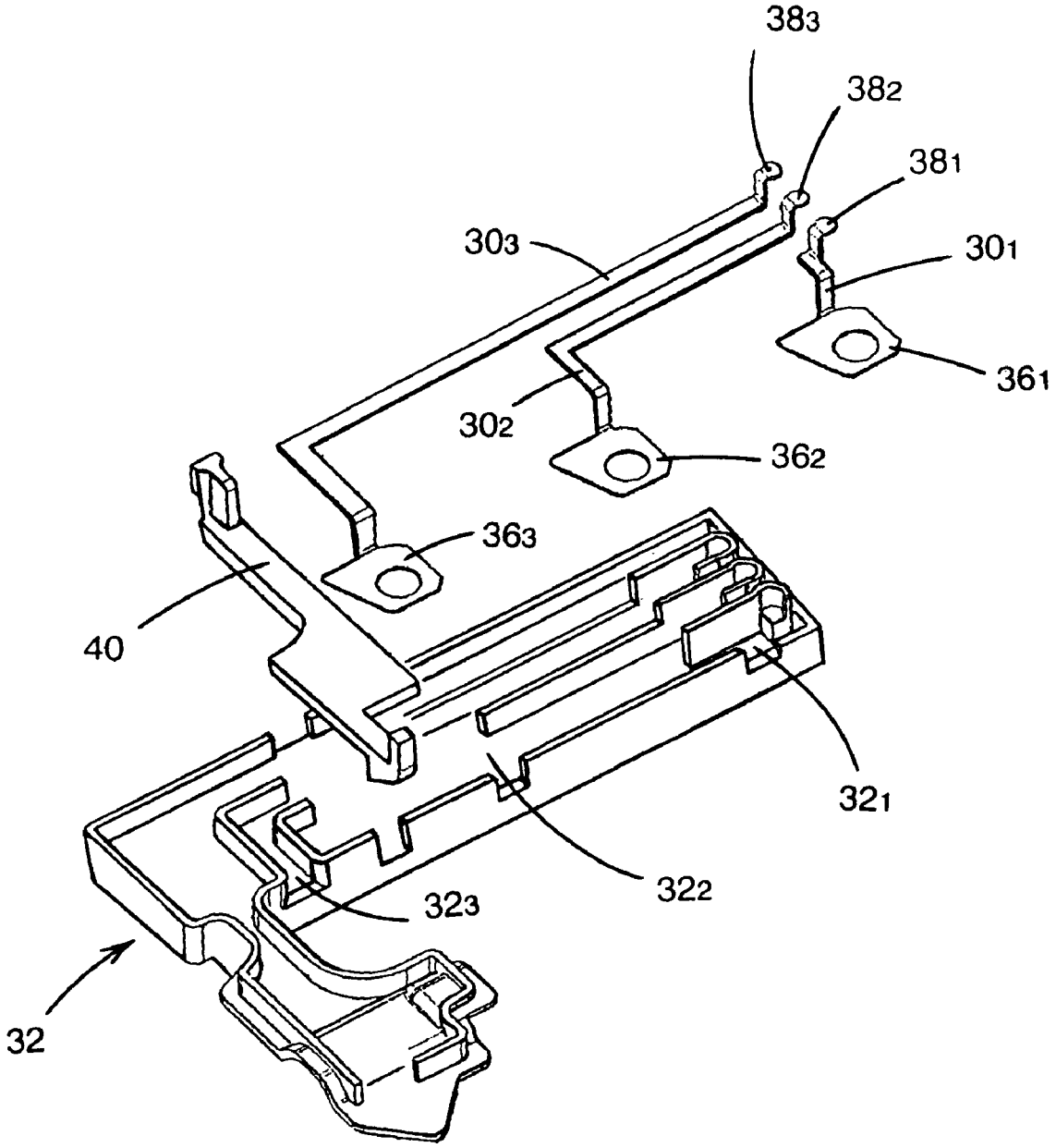
FIGS. 2A to 2H show the successive assembly steps of an electronic trip device according to a preferred embodiment of the invention.

As illustrated in FIG. 2A, a double bottom 32 made of moulded plastic, with a shape identified by bottom part 22 of the electronic module, comprises arrangements $\mathbf{32}_i$, with i=1 to 3, on its top surface delineating passages for voltage tap conductors $\mathbf{30}_i$. These chicanes $\mathbf{32}_i$ form error prevention means of each conductor 30 preventing any assembly error, while at the same time guaranteeing electric insulation of the different voltage taps from one another. Double bottom 32 is further arranged to enable connecting strips $\mathbf{36}_i$ to be situated outside bottom part 22 once assembled, whereas connecting strips $\mathbf{38}_i$ are accessible from the inside of main cavity 28A of bottom part 22. Chicanes $\mathbf{32}_i$ are preferably arranged in such a way that connecting strips $\mathbf{38}_i$ are aligned in a width-wise direction of double bottom 32 to facilitate data processing. The shape of conductors $\mathbf{30}_i$, which are preferably flexible, between the two ends $\mathbf{36}_i$, $\mathbf{38}_i$ is thereby given by chicanes $\mathbf{32}_i$ of double bottom 32.

Arrangements $\mathbf{32}_i$ of double bottom 32 preferably form actual insulating ducts accepting rough-cut conductors $\mathbf{30}_i$ which enables costs to be reduced. Conductors 30 can be made of stainless steel, with a voltage tap at the level of second end 38 achieved by means of gold-plated contacts acting as springs (FIG. 3). These choices guarantee a continuity of contact for currents and voltages of low level of the signal conveyed, while at the same time eliminating galvanic risks and ensuring electrochemical compatibility with conductors 17 of transformer unit 10 and/or of the circuit. In addition, the use of a stainless steel foil strip 30 of small thickness does not require any specific liner coating to prevent corrosion, and its mechanical qualities associated with specially designed supports on the surface of double bottom 32 enable several assembly and disassembly operations to be guaranteed by screwing connecting strips 36 onto transformer unit 10 with recommended torques, without the parts being degraded from a functional point of view, or from an aesthetic point of view for first end 36 remaining visible outside case 20.

Voltage tap conductors 30 are thereby housed in an integration space of bottom part 22 formed by assembly of the two walls 32, 34. This space can also be used to integrate other functional elements in case 20 of the electronic module, for example a control means 40 for an auxiliary module. If mechanical transmissions from trip device 200 to other units than switchgear device 3 of circuit breaker 1 are envisaged, the means necessary for this type of operation can in effect be provided right from the moment assembly of trip device 200 is performed. In particular, an arrangement of double bottom 32 can be made for a part 40 transmitting a push on a safety module located outside electronic trip device, in particular a differential protection unit as described in the document FR 2 701 335. Push actuator 40 is advantageously made from charged thermoplastic material and its shape ensures a rigidity procuring an optimised force transmission. Preferably, the shape of the housing provided for push actuator 40 guides the latter in sliding without any risk of jamming and guarantees precise bearing points of good quality. Fitting of actuating means 40 is quick, without any risks of errors and does not require any specific tooling. It may be preferred to fit this option for all trip devices 200, including when it is not certain that the available mechanical actuating means 40 will be used.

In an electronic module, the quality of the connections between conducting metal parts and printed circuit boards depends partly on the level of tightness. According to a preferred embodiment of the invention, double bottom 32 is secured to bottom 34 of first part 22 of case 20 by ultrasonic welding. This solution further guarantees the mechanical strength of voltage tap conductors 30. Additional actuating means 40 are provided with the same advantages of protection against polluting environments and post-breaking projections.

Figure 2B:
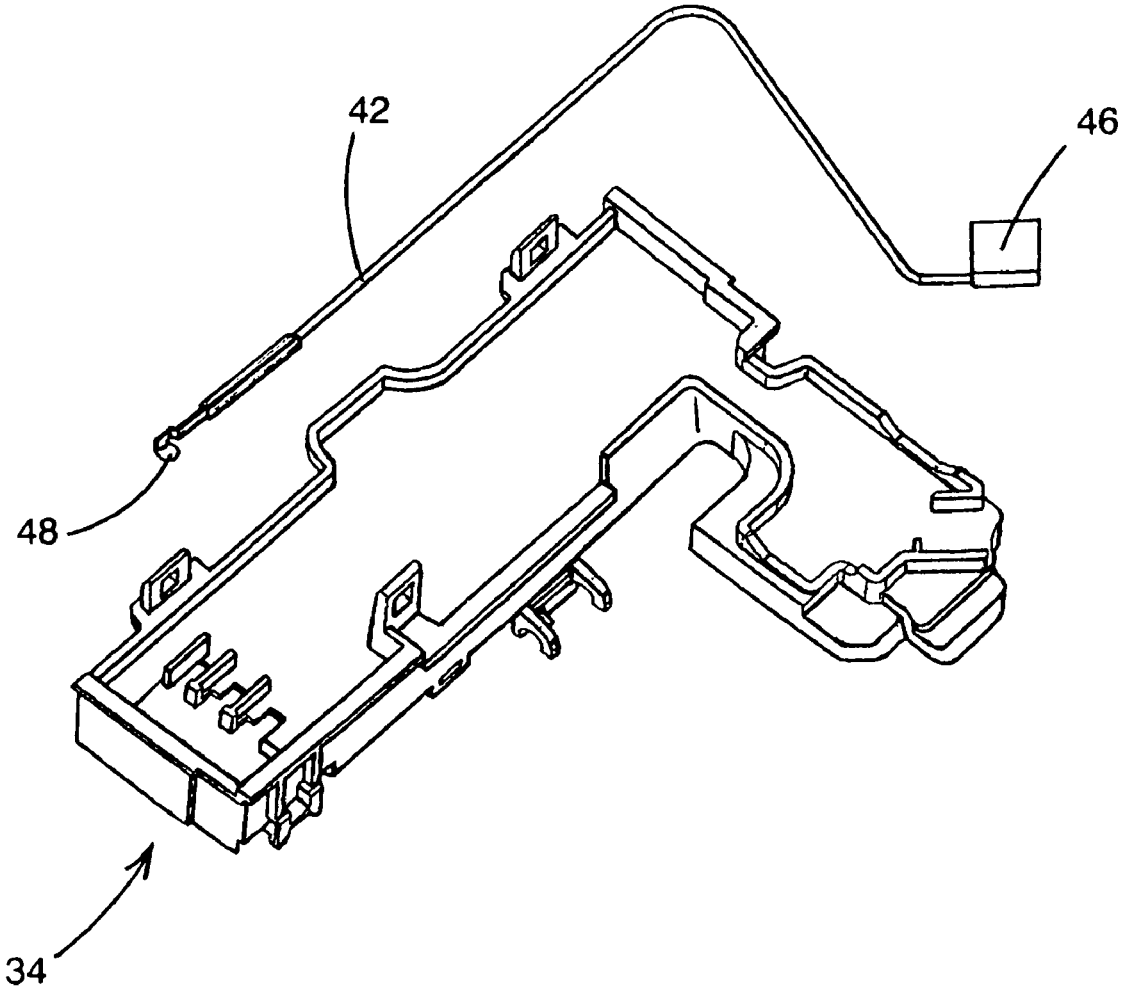
Figure 2C:
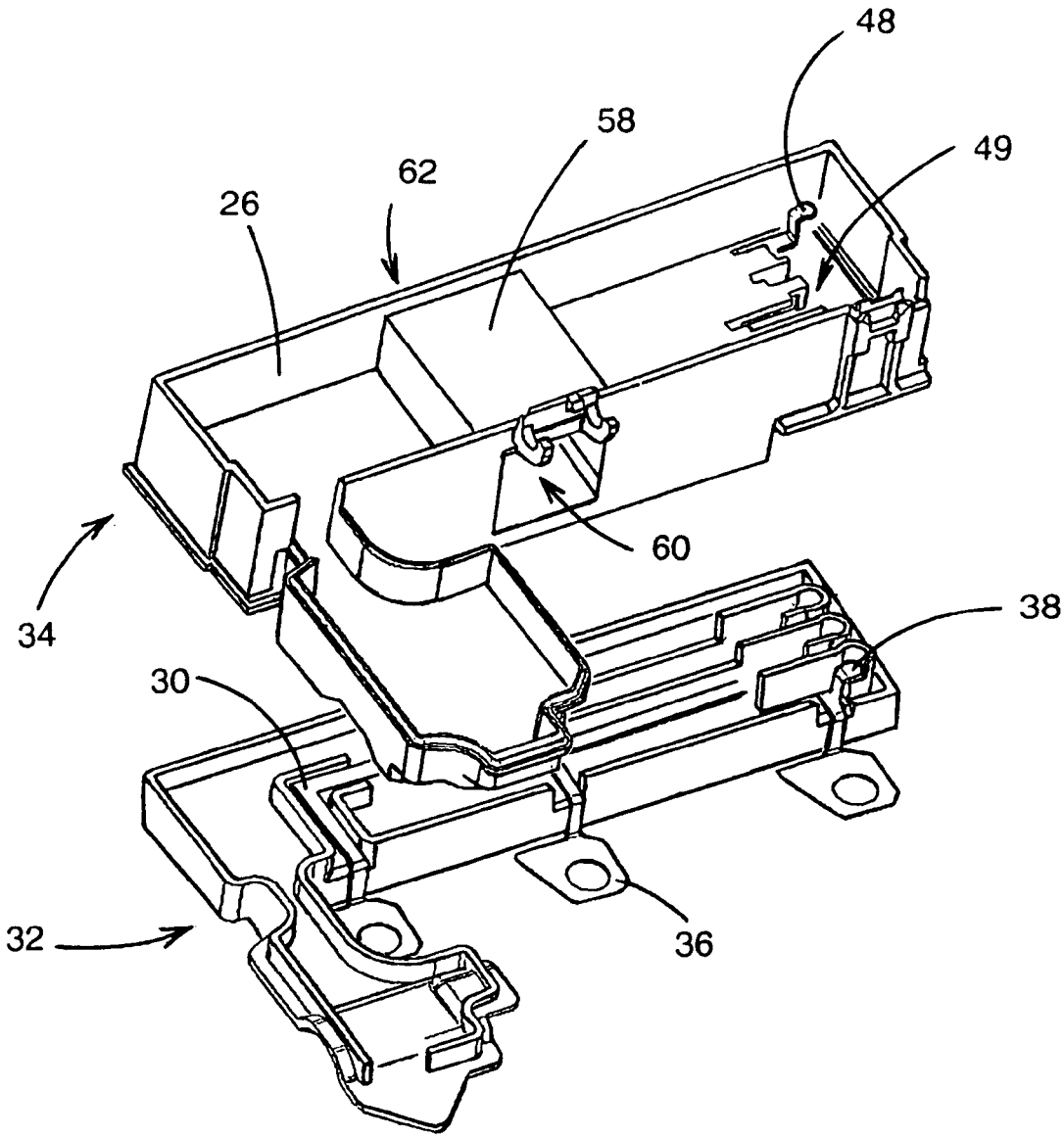
Figure 2D:
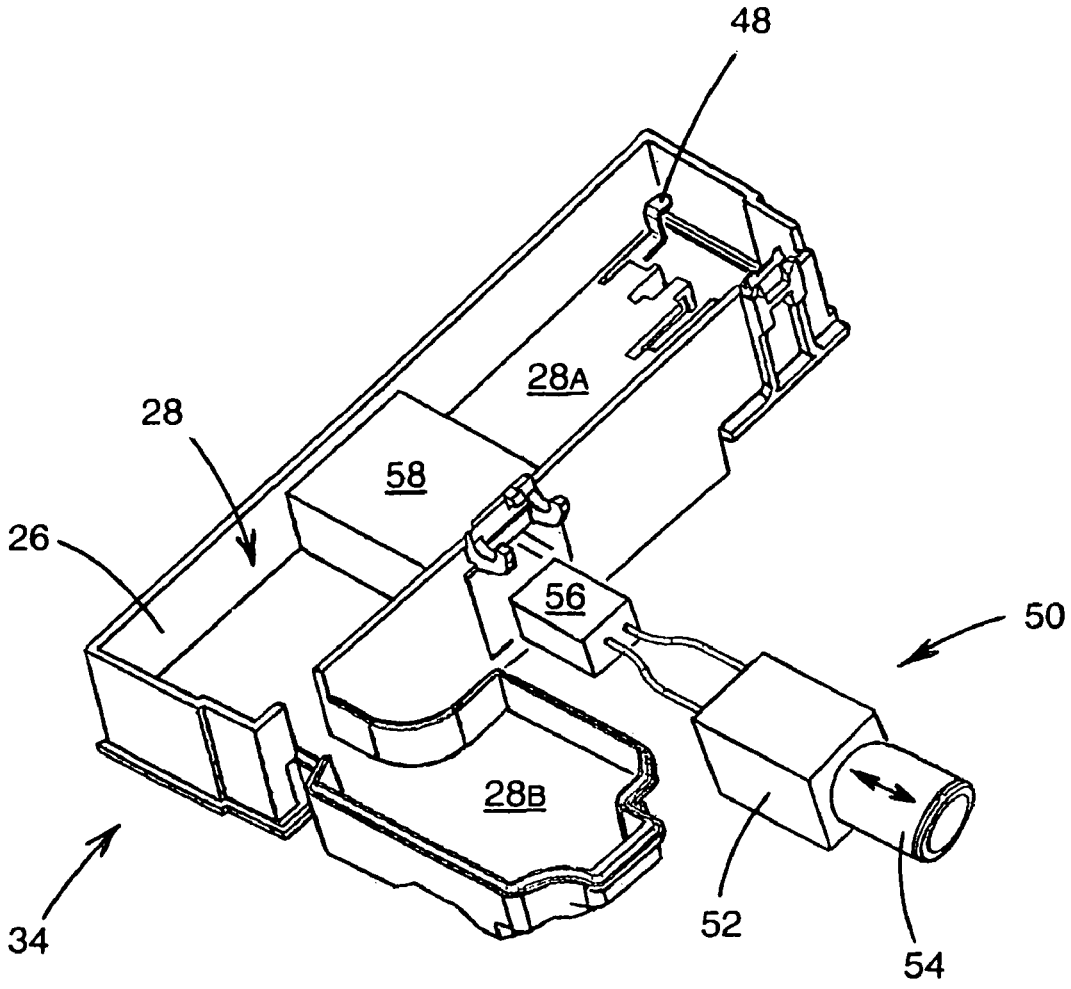
Figure 2E:
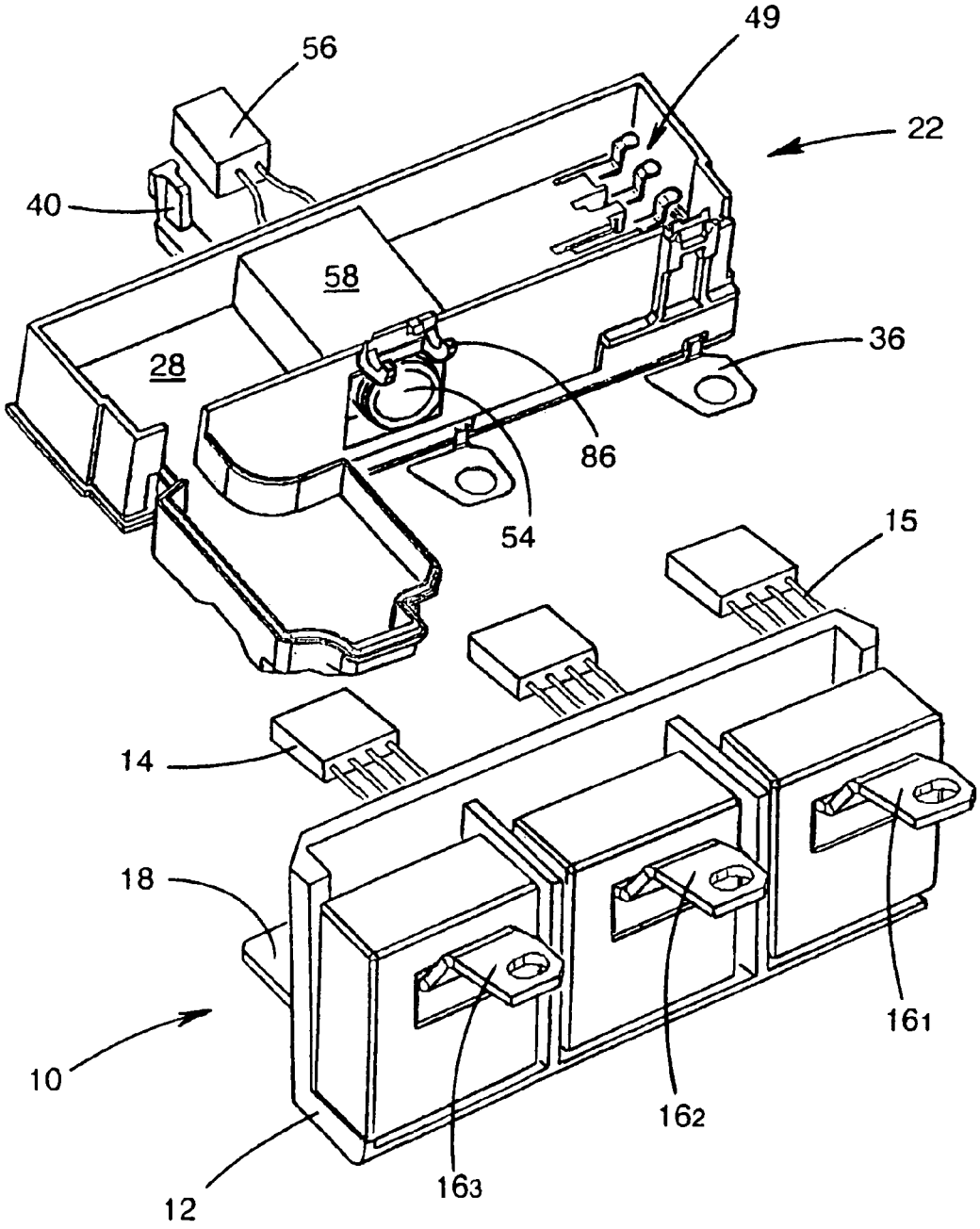

To enable precise voltage measurement and reliable determination of the power and the energy balance of switchgear device 1, it is recommended to introduce a real value of the neutral voltage in the electronics. In the case of three-pole circuit breaker 1, it is thus advantageous to integrate an additional conductor 42 in bottom part 22, which conductor comprises a connector 46 at one end in order to be connected to wiring coming from the neutral of installation 1. Neutral conductor 42 can be a wire in a heat-shrink sheath crimped at the other end onto a connecting strip 48, such as a stainless steel blade. Advantageously, as illustrated in FIG. 2B, this neutral wire 42 is fitted in suitable arrangements made on the bottom surface of bottom 34 of the electronic module. Assembly of neutral wire 42 is thereby facilitated, all the more so as it is possible to secure it in chicanes to hold it when bottom 34 is "turned" for assembly on double bottom 32.

As illustrated in FIG. 2C, bottom 34 and double bottom 32 are thereby preferably moulded from thermoplastic material and their outer surfaces do not comprise any openings on the critical insulation path, with the exception of an access 49 to terminal strips 38, 48 of current tap conductors 30 and of neutral conductor 42. Bottom 34 and double bottom 32 are then welded onto one another so as to secure elements 30, 40, 42 that are integrated therein and to protect the latter against any external contamination. Dielectric insulation is thereby also ensured, so that the risks of spurious tripping of circuit breaker 1 are minimised and the functional reactivity of the trip device is guaranteed.

Bottom part 22 of case 20 of the electronic module is thus L-shaped with a cavity 28 comprising a substantially rectangular main portion 28A and a substantially orthogonal extension 28B. An actuating means 40 (not illustrated here—see FIG. 2A) and voltage tap conductors 30 and a neutral wire 42, only ends 36, 38, 46, 48 whereof are accessible, are integrated in the bottom face of bottom part 22, each of these elements having been fitted in dependable and simple manner without requiring any specific tooling. Some of these elements 30, 40 can moreover be common to different ranges of circuit breakers 1, thereby rationalising management of the components.

It should however be noted that these assembly steps of bottom part 22 illustrated in FIGS. 2A to 2C are not indispensable. In particular, for four-pole circuit breakers and trip devices, there is no neutral wiring 42. Additional auxiliary pusher 40 and/or current tap conductors 30 can also be omitted. Bottom part 22 can then be unitary. It is also possible, in particular if tightness around the integrated elements is not required, for bottom part 22 to be composed of two walls 32, 34 simply adjoined and secured to one another by any other means (clips, screws, etc.).

According to the invention, actuator 50 of the contacts of switchgear device 3 is integrated in trip device 200, and more particularly in the electronic module, in order to increase the reactivity of the latter. Advantageously and even if other alternatives such as a piezoelectric trip device are possible, a small electromagnetic trip device 50 is used, for example as described in the document FR 2 893 445. This type of actuating device 50 illustrated in FIG. 2D comprises a magnetic yoke 52 surrounded a mobile armature extended by a pusher 54 that can take a rest position in which it is kept close to yoke 52 by a spring (FIG. 2E), and an actuating position in which it is protruding. Movement of the mobile means is caused by a magnetic force within yoke 52, generated by a current signal from a connector 56.

Contact actuator 50 has to be electrically insulated from the electronic components of the module. It is therefore fitted in first bottom part 22 inside a sheath 58 that is hermetically tight with respect to cavity 28 designed to further accommodate the electronic processing unit. Alternatively, sheath 58 as such can comprise open holes on cavity 28, holes that operate in conjunction with actuating device 50 (for example via a set of pins, not illustrated, on yoke 52 and the walls of sheath 58) in such a way that the fitted assembly formed by actuator 50/sheath 58 is tight with respect to said cavity 28. Furthermore, and in particular for an electromagnetic actuator 50, positioning and movement along the axis of moving part 54, which are important for reliability, are ensured by a suitable shape and size of sheath 58, which is securedly attached to walls or first side panels 26. Advantageously, on account of the compactness of the electronic module according to the invention and the small amount of space available in cavity 28, sheath 58 is integrally moulded in bottom part 22, one of its walls being formed by the bottom surface of case 20. Precision of axial positioning is thereby ensured when bottom part 22 is manufactured, sheath 58 being centred on a predefined reference system. The absence of intermediate parts moreover results in a short and optimised chain of dimensions.

Sheath 58 is in the general shape of a parallelogram, its top face, opposite and parallel to the bottom of cavity 28A, preferably lets first side panels 26 extend there-beyond in order to be able to position and guide a printed circuit board on this surface. Sheath 58 comprises a hole 60 at a first side panel 26 of bottom part 22 for fitting of device 50, and which advantageously acts as passage for actuating means 54. Actuator 50 preferably acts between two connecting strips $\mathbf{36}_i$, $\mathbf{36}_{i+1}$. Sheath 58 further comprises means for passage of connector 56 of said actuator 50, preferably a second hole 62 on the opposite wall from assembly and actuation hole 60. Actuating device 50 thus takes a rest position and can protrude from sheath 58 when its connector 56 transmits the information necessary for tripping. Due to the location of board 64 above actuator 50, the connection of connector 56 can be flexible and short, and connector 56 is preferably coupled to board 64 via the edge, as described in particular in document FR 2 907 265.

The size of sheath 58 is adjusted so as to provide mechanical strength and support and to perform guidance of its movable means 54. Error prevention means can also be fitted, for example a raised obstacle placed asymmetrically in sheath 58 and operating in conjunction with actuator 50, to prevent assembly errors and damage of the parts involved. Preferably, to improve the functional clamping of device 50 and the resistance thereof to shocks and vibrations generated by transformer unit 10 and resulting from tripping, the inside panels of sheath 58 comprise clips, thereby not requiring the use of added elements. This advantage can in particular be useful when the module is being assembled and before the latter is fitted in the case of circuit breaker 1, to prevent any accidental "loss" of electromagnetic device 50. This solution results in simple assembly and disassembly of actuator 50, without any specific tools being required, in spite of the small clearance constraints on the housing.

Bottom part 22 equipped with actuator 50 (which can itself be fitted in bottom 34 before being assembled on double bottom 32) can be assembled on transformer unit 10, as illustrated in FIG. 2E. This assembly could be performed earlier, but to the detriment of ease of insertion of electromagnetic actuating device 50, or later, but with the constraints resulting from the presence of printed circuits 64 in space 28. Advantageously, securing is achieved by suitable shapes of case 12 of transformer unit 10 and of bottom part 22 of the electronic module by clipping the two elements 12, 22 on one another, although other means such as securing by screws can be envisaged. This solution makes for quick and direct assembly, while at the same time allowing disassembly with suitable tooling. Optimisation of the geometries of the securing means, with clips "working" along perpendicular axes, moreover enables the resistance of the assembly to stresses to be guaranteed. Furthermore, the complementarity of the shapes, with guiding or error prevention, is designed to ensure alignment between connecting strips $\mathbf{16}_i$ and connecting strips $\mathbf{36}_i$ of voltage taps $\mathbf{30}_i$.

According to an option, to limit pollution that may reach trip unit 200, a membrane can be fitted between switchgear unit 10 and trip device 200. Indeed, in particular for three- and four-phase breaking devices, some breaking operations at high voltage can generate particles which escape from the cartridges of breaking device 3 and could be deposited at the level of voltage taps 30, under double bottom 32. Fitting a part (not shown) snugly following the shape of switchgear unit 10 prevents pollution from getting up into the connection zone of trip device 200, while at the same time participating in its strength during shocks and vibrations. For example, a moulded silicon shield, the flexible material whereof further enables adjustment securing of transformer units 10, is particularly suitable as it can also increase the dielectric strength between active parts.

It should be noted that, due to integration of the components already fitted in bottom part 22 (voltage and neutral tap conductors 30, 42, actuating means 40, 50, and so forth), and to the smallness of connecting means 14, 56 extending there-beyond, no risk of pinching the wires is to be feared. It is moreover possible for all the elements described in the assembly on completion of the step illustrated in FIG. 2E to be present, whatever the final options of the trip device chosen by the user. Some elements then remain unused. It is also possible to omit some assembly steps, in particular by eliminating some superfluous components.

Figure 2F:
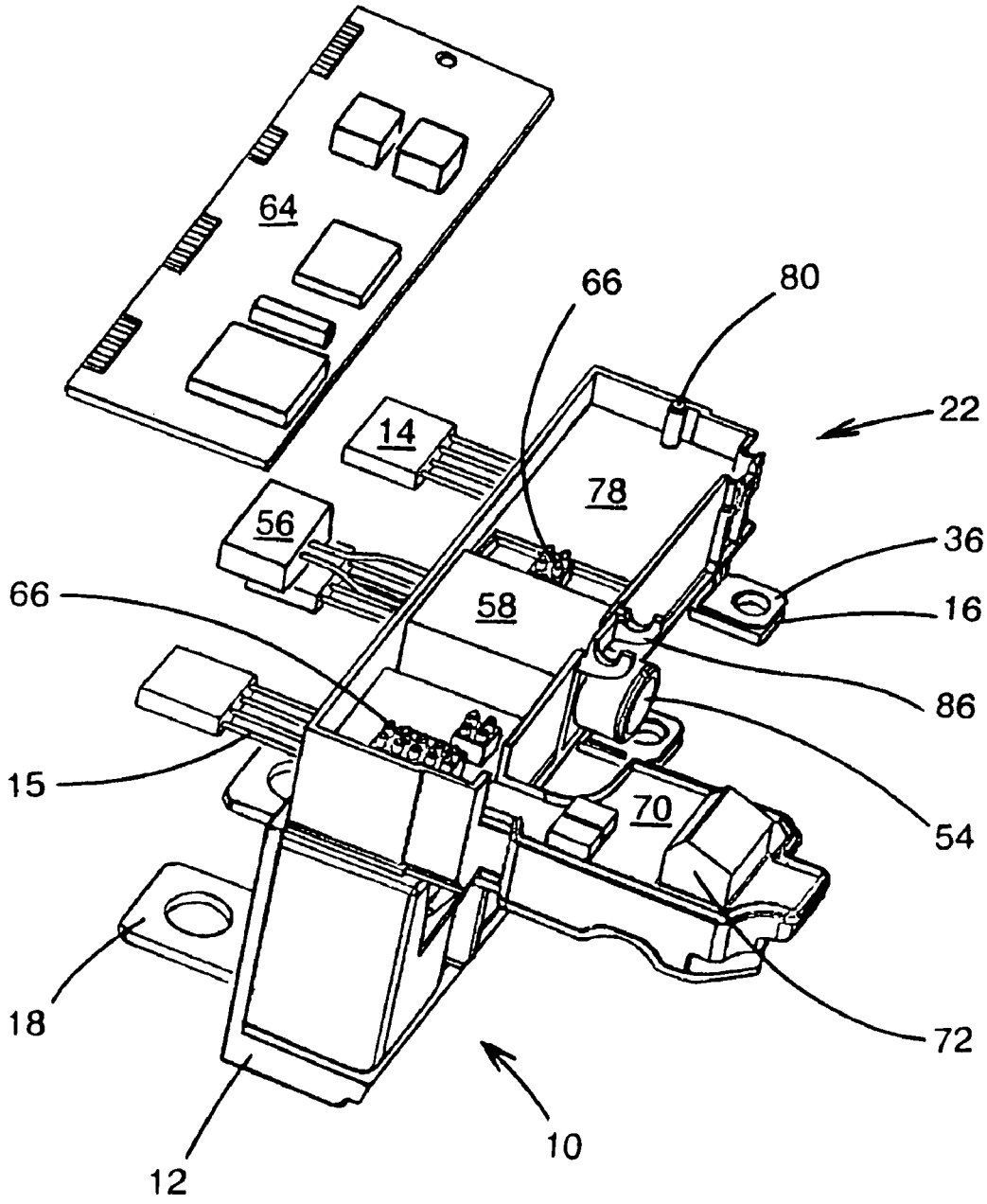
Figure 2G:
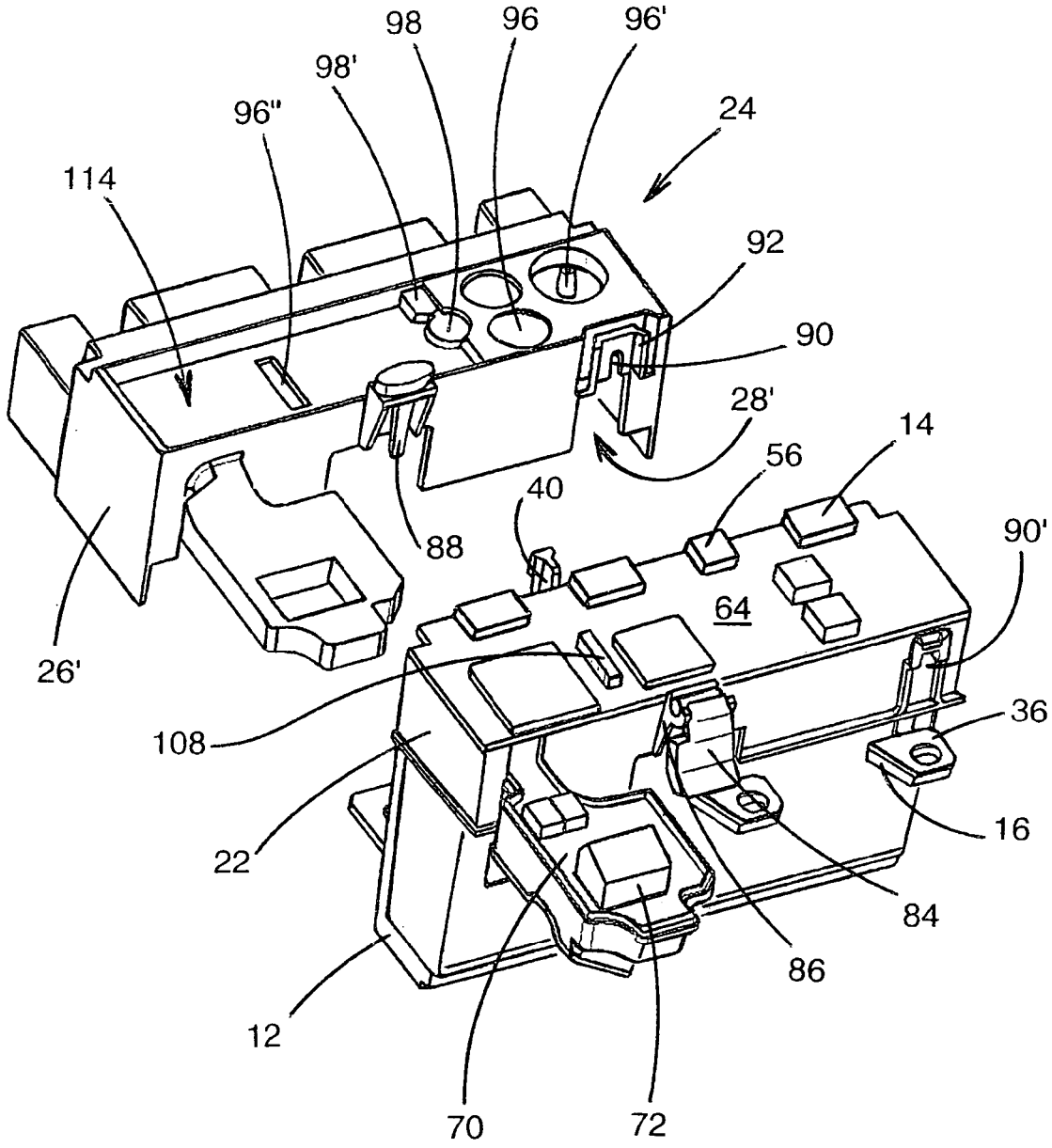
Figure 2H:
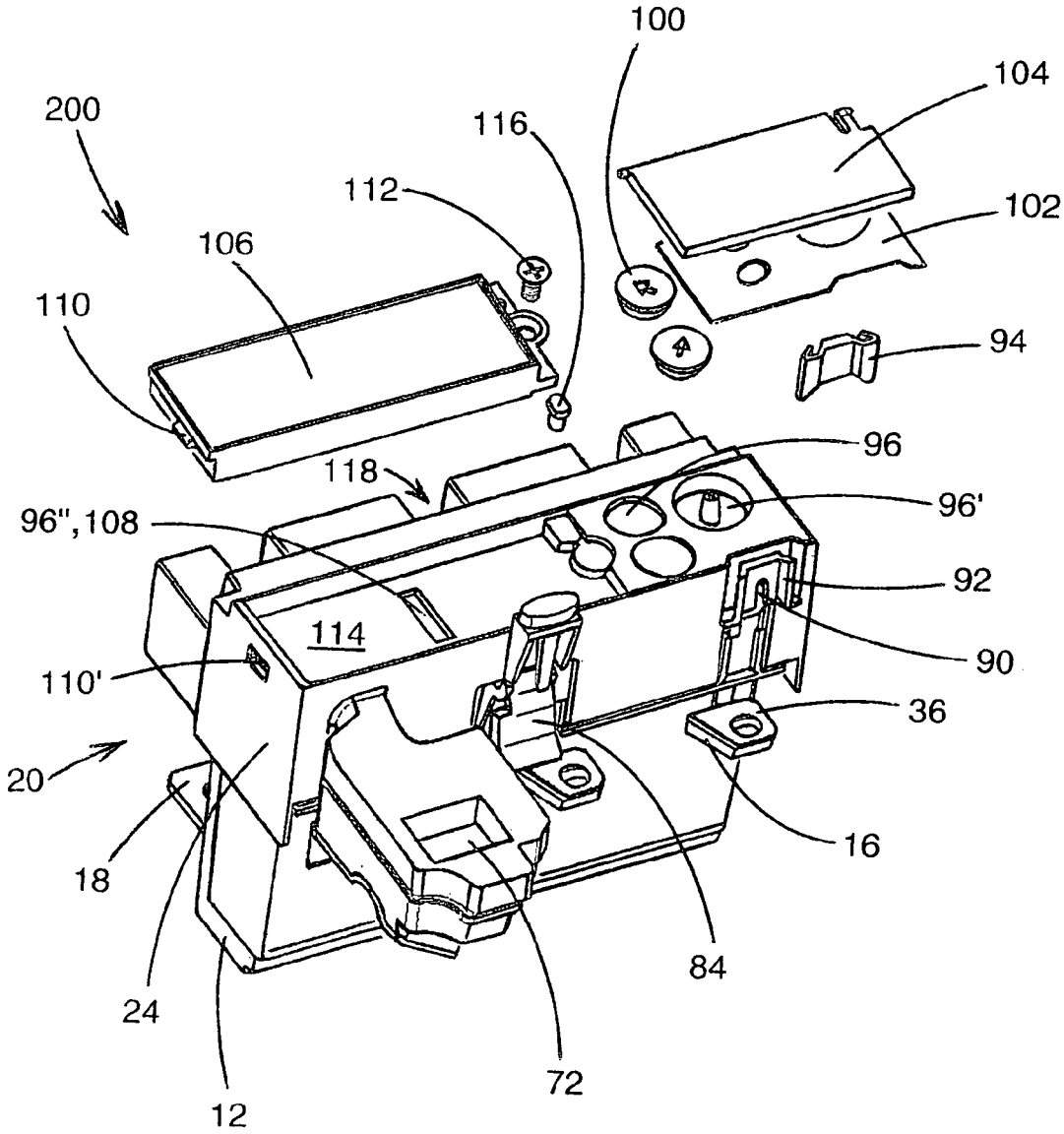

Assembly of a trip device according to the invention is continued by fitting the electronic processing unit comprising one or more printed circuit boards performing the different functions required (FIG. 2F). In the preferred and detailed embodiment, three boards are fitted, but it is clear that the different functions can be separated into a larger or smaller number of boards or that only main board 64 of the processing unit can be present. To rationalise manufacture of the trip devices, it is advantageous for the interfaces dedicated to each optional functionality to correspond to a board, and for the circuits corresponding to processing of the different functions to be transported to a main board 64 of the processing unit.

According to the invention, although it is very compact and integrates actuating device 50, the electronic module can perform a large number of functions. To meet this density requirement, the electronic boards relative to the different functionalities are stacked in case 20 of the module, and communications are made directly by means of non-wired contacts 66, of spacer stud type, preferably having a spring function so as to compensate the static indeterminancy of stacking of coplanar boards for data transfers to be reliable in all cases. According to a preferred embodiment of the invention, the flexible non-wired communication means 66 are of piston type with suitable travel so as to absorb shocks and vibrations without generating any stress on the boards. Optimisation of the travels and integration of springs with this type of connection 66 further enables the dimensional variations of different levels to be absorbed, ensuring permanent contact. To transmit the very weak current signals (about 5 mA) associated with voltages close to 0 V such as those present in an electronic trip device, contacts 66 are coated on the surface thereof with a suitable material, in particular gold.

For data transmission to be direct, it is preferable for each additional board to be placed at least partially facing main processing board 64 which performs the tripping functionality. Central board 64 is preferably of a size corresponding to main part 28A of cavity 28, i.e. it is substantially of the same size as case 12 of transformer unit 10. For the sake of simplification of manufacture and rationalisation of procurements and storage, it is preferable for the latter not to form the complete L. Main board 64 preferably comprises the printed circuit performing the tripping functions including all the options of a trip device 200 according to the invention, with in particular the parameter setting means, such as thumbwheels, and connecting strips, preferably on the sides, for connectors 14, 56 of transformer unit 10 and of bottom part of case 20. Contacts 66 for transfers within the processing unit are formed on the other boards arranged back-to-back with the latter.

Assembly of the processing unit boards can be performed prior to fitting of the secured assembly in cavity 28, for example by clipping by suitable means. Another option, illustrated in FIG. 2F, consists in superposing the boards one after the other in cavity 28 of the case. Alignment means of studs and holes type can be provided on the boards and bottom part 22, as can clips securing the stackings. Whatever the option chosen, assembly of the electronic unit is achieved in simple and reversible manner, without any specific tooling, and disassembly does not damage the connections.

In particular, as specified above, the preferred embodiment comprises a customer interface located at the level of base 28B of the L, for example to enable the user to make a communication with external means and/or to connect wires. An interface board 70 is fitted in this part 28B of case 20, partially overlapping on central part 28A, contacts 66 to main board 64 and the user interface means 72 being arranged on the top face thereof.

In the preferred embodiment of the invention and as specified above, the voltage of the circuit is measured by conductors 30 and the value thereof is processed. In order to guarantee user safety, regulatory insulation has to be performed, with in particular lowering of the measured voltage before the latter is transferred to main circuit board 64. A specific board 74, called voltage board, is fitted for this purpose, preferably in the residual space next to sheath 58 of actuating device 50 and facing terminal strips 38 (and 48) of voltage 30 (and neutral 42) tap conductors. Voltage dropping resistors of the circuit enable the initial voltage to be reduced by a factor of about a thousand before the data is communicated to processing unit 64, which guarantees the regulatory resistance of the module front panel and ensures user safety. As mentioned in the above and illustrated in FIG. 3A, data transfer from voltage tap conductors 30 to board 74 is performed at the level of their second end 38 via the appropriate hole 49, preferably orthogonally with respect to the bottom by means of gold-plated pins 76. Advantageously, to compensate for any clearances and to increase manufacturing tolerances, contacts 76 are also in the form of pistons, advantageously fitted on voltage board 74.

Figure 3A:
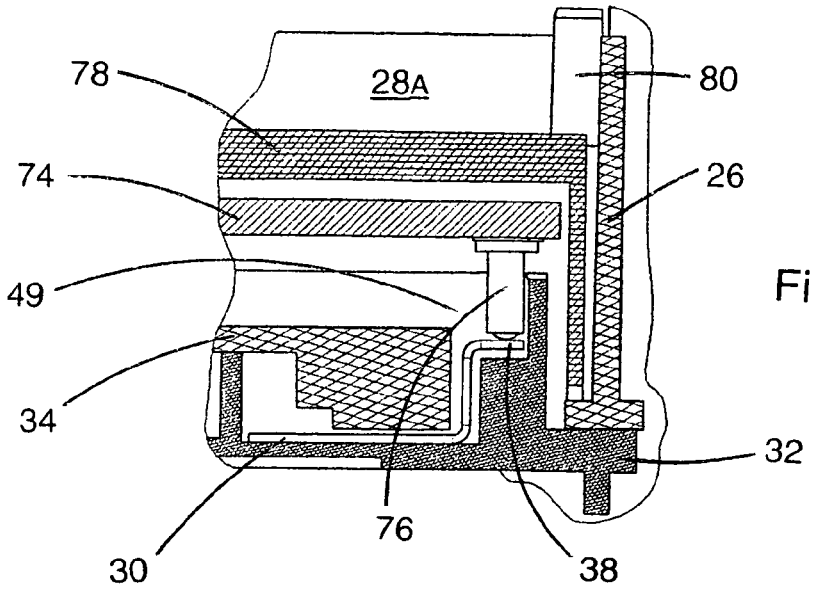
FIGS. 3A, 3B and 3C represent fitting of a voltage tap board in a preferred embodiment of the invention.
Figure 3B:
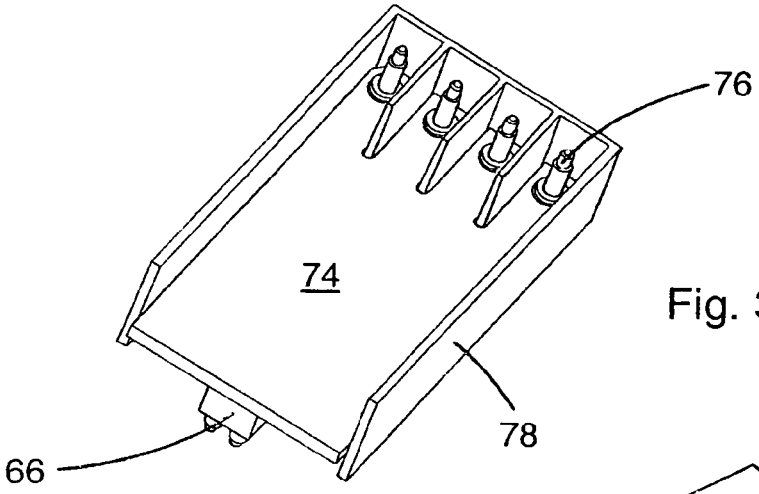
Figure 3C:
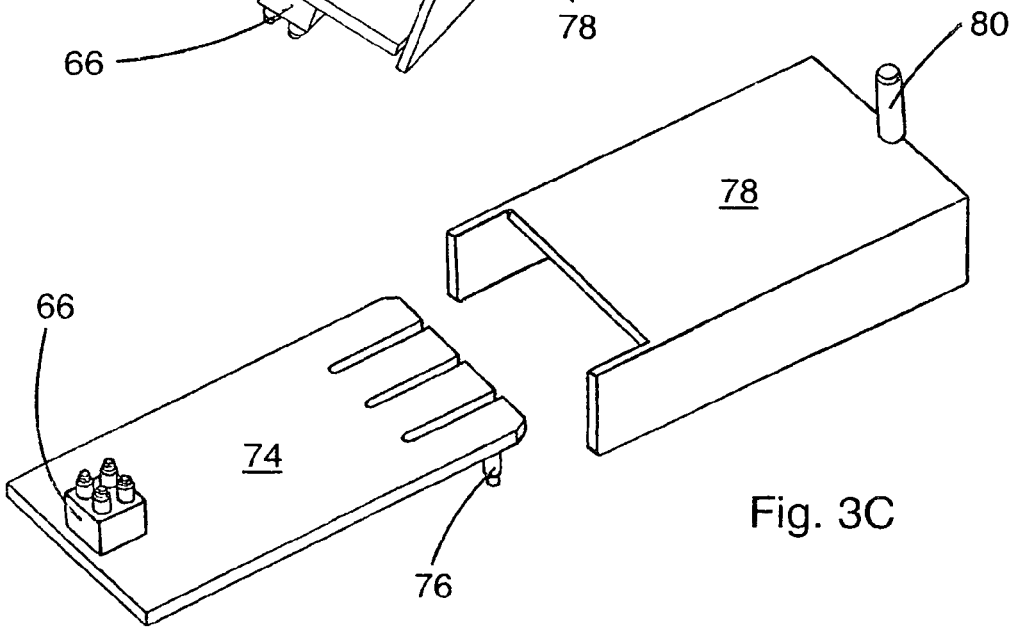

Voltage board 74 is fitted with an insulating thermoplastic shield 78 that can be integrated in cavity 28 of case 20 without any specific tools, the strength and precise positioning of which shield being ensured by details of shape and by clips. Indeed, in the same way as insulation of voltage tap conductors 30, strict electrical separation of voltage board 74, with the exception of connectors 66 with main board 64, guarantees correct operation of trip device 200. As illustrated in FIGS. 3B and 3C, insulating shield 78 is preferably manufactured in such a way that board 74 forms a securedly affixed assembly therewith before being inserted in cavity 28 of case 20, guiding grooves with error prevention being able to be present for ease of fitting of printed circuit 74 in shield 78. Advantageously, to check the presence of voltage board 74 and of its shield 78, even at a late stage in assembly of trip device 200 according to the invention, the shield can comprise a pin 80 visible on the front panel, which can be detected by any means, including automatic means of camera type.

Assembly of the electronic module is continued by fitting processing board 64 in the main part of cavity 28, above the others 70, 74 and sheath 58 of electromagnetic actuator 50. Main processing board 64:

- processes the current data received from the distribution circuit by means of connectors 14 of transformer unit 10 to determine whether the operating conditions require tripping or not;
- receives, via non-wired connectors 66, voltage measurement data processed from voltage board 74 which takes the latter from current input conductors 16 via voltage 30 (and neutral 42 if applicable) tap conductors;
- sends data to actuator 50 via its interface 56;
- sends data to the user interface board 70.

Once boards 64, 70, 74 have been fitted in cavity 28 of bottom part 22 of case 20, the connections from transformer unit 10 and to actuating device 50 are made, in particular by brazing connectors 14, 56 onto board 64, preferably on the edge of the latter.

Due to the choice of flexible direct contacts 66, the restricted space is not an impediment for the number of data transfer means. Connectors 14, 56 can moreover be housed in the available space. It is advantageous to reduce the wired length 15 of connectors 14, 56, and in particular to limit same so that the flexible parts are pressing along side panel 26 of the bottom part 22 of case 20 when connected.

Before completing assembly of case 20 by closing bottom part 22 by means of cover 24, a striker 84 is positioned facing outlet hole 60 of mobile push-rod 54 of actuator 50 to form the interface between actuator 50 and switchgear device 3. In addition to the different mechanical qualities between these two elements 54, 84 justifying the presence of a striker 84, it is in fact frequent for integration of an electromagnetic actuating device 50 in electronic module 200 to imply the presence of an intermediate element 84 able to offset the axis of the tripping force. Conceptually, the axes of the transmitting part 54 and receiving part can be not aligned to one another. Striker 84 is thus designed with a form enabling the thrust axis to be transferred. Furthermore, the design of striker 84 is optimised for quick assembly with error prevention by asymmetric shapes. In particular, it is fitted on guides 86 of side panel 26 of bottom part 22 of case 20, the sets of clearances of which are optimised to guarantee precise bearing points. To prevent any risk of losing striker 84 during the assembly steps, it is advantageous for the axial positioning of this striker to be completed only when bottom part 22 is closed by cover 24. For example, whereas striker 84 is engaged in a "vertical" position on its guides 86 and then folded down before being closed off by cover 24, a flexible tab 88 of cover 24 then biases it to an operating position.

The assembly can be closed by second part 24 of electronic module case 20 forming a cover, which operates in conjunction with bottom part 22 and comprises a passage facing hole 60 of sheath 58 enabling movement of actuator 50 and striker 84 towards the outside.

As specified above, for reasons of tightness, cover 24 is preferably provided with side panels 26' forming a cavity 28' in which the whole of bottom part 22 and of previously assembled components are fitted, with the exception of striker 84 which is however held in place by cover 24, and of connecting strips 16, 36. Connectors 14, 56 with main printed circuit board 64 are thus protected from the environment, being located between side panels 26, 26' of the two parts of case 20 (FIG. 2G).

It is moreover possible to leave an optic passage 90, advantageously arranged to maintain the tightness of cavity 28 by matching the shapes. In addition to mechanical actuating part 40 mentioned above, the electronic module according to the invention also in fact preferably comprises additional means for communicating with a remote auxiliary, such as an earth fault detection device. On account of the restricted space and the optional aspect of this type of additional function, the communication means integrated in the trip device according to the invention do not comprise wired connectors but are based on an optic connection 90 implemented on processing unit 64 of the electronic module according to the invention. This type of connection is reliable and insensitive to pollution, with an absence of physical contact between connection points which excludes the risk of wear due to friction resulting from vibrations.

Case 20 is thereby designed with additional assembly means for an auxiliary module, in particular a fitting rail 92 on a side panel 26' of cover 24, for example of dovetail type, so that assembly and disassembly operations of an auxiliary module (not shown) connected thereto are easy while keeping the mechanical strength to resist shocks and vibrations when the clearances are optimised. Securing of the auxiliary module on the trip device can be performed by an element of clip type. Auxiliary module fitting rail 92 is moreover designed to enable an optic connection 90 between main printed circuit board 64 and the module fitted on rail 92, for example a hole in rail 92 on panels 26, 26' of case 20 operates in conjunction with a diode fitted under board 64, preferably ensuring the tightness of cavity 28A even if no auxiliary module is fitted. Auxiliary module is also provided with a diode facing that of trip device 200 in its fitted position. The two means can exchange their data by means of optic path 90, 90' arranged in walls 26, 26' and that of the auxiliary module case. The optic connecting means preferably comprise red transmission/receipt light-emitting diodes, the wavelength representing the best trade-off between functionality and cost.

Advantageously, when this optic connection 90 option is not used, a protection element 94 (FIG. 2H) is fitted on the assembly means 92 to preserve the tightness around main board 64 and blanking off the optic connection. This type of blanking shutter 94 can be such as to further enable immediate identification of the presence of such an optic connection 90, for example by choosing an appropriate colour. Furthermore, the choice of material, for example by using a transparent (but preferably coloured) protection element 94, can also enable the latter to be kept in place for testing the reliability of the optic connection in the absence of an auxiliary unit. In particular, such a device as described in FR 2 910 174 can be associated with the trip device according to the invention by one such mixed connection 90, 92, this association being able to be achieved leaving the electronic module powered-on, i.e. whereas the circuit breaker is in operation.

Preferably, the tightness of cavity 28 containing the electronic unit of the module is completed by clipping cover 24 on bottom 22, an operation that is simple and quick while remaining reversible (FIG. 2G). Top surface of cover 24 does however contain holes 96, 96', 96" necessary for operation and parameter setting of trip device 200. The part forming cover 24 is advantageously produced in integral manner in moulded plastic. It is preferable to fit most of the interfaces relative to operation of the trip device after the trip device has been assembled and electronic module 20 has been protected. Inserts for assembly of external auxiliaries, such as means 98 for fitting a read-out display or a keypad lock button 98', can however be integrated in monoblock cover 24 before the latter is clipped onto first part 22 of case 20 of electronic module 200.

Once case 20 has been closed, buttons 100 for setting the tripping thresholds parameters, a preferred embodiment of which is described in FR 2 913 143, can be fitted in suitable holes 96 to operate in conjunction with thumb-wheels of processing board 64. Other alternatives are possible, in particular fitting control devices 100 on board 64 before cover 24 is fitted in place. An information tag 102 and a protective plate 104, preferably a transparent visor, are positioned at the level of parameter setting means 100 and of test connector 96' to protect the latter against external aggressions. Device 94 protecting the optic connection is also advantageously fitted, for example by pinching on rail 92.

The data from the electronic circuits can moreover be displayed on the top surface of case 20 by elements of indicator light type. Remanent display devices can in particular be used, in particular using the bistable cholesteric technology. The data is thus indicated even in case of a power supply outage by a change of colour of one (or more) pixel(s) of an indicator light of a few $mm^2$ taking two colours typical of the state, for example red and green.

According to a preferred embodiment, a part of the top surface of case 20 is dedicated to fitting a flat display module 106 communicating directly with strips 108 of underlying processing board 64 via vertical contacts passing in a recess 96" provided in the part forming cover 24. Advantageously, to compensate the static indeterminancy, here again piston contacts 108 are used. Preferably, display 106, for example of pull-down menu type, is fitted simply and reversibly by two connecting points, for example a fixed latch/hole 110, 110' cooperation on one side and a screw 112 cooperating with insert 98 of cover 24 and fitted captive on display 106 on the opposite side. The mechanical strength does however meet standard requirements, in particular if insert 98 is made of metal, for example of brass fitted ultrasonically. To guarantee a functional tightness of IP4 type and to protect electronic module 106 against dielectric breakdowns, a recess 114 is made in the top face of cover 24 for display 106 to form a flat surface with the rest of cover 24/plate 104 while being insulated from the electronic circuit. Printed circuit board 64 is in fact inaccessible with the exception of contacts 108, so that the electronics of the trip device according to the invention are protected, including when actions are performed on display 106, which actions can be performed keeping the electronic module powered-on if required.

Locking of the top part of cover 24 can be associated with these last assembly steps, for example a switch 116 preventing the programming from being modified to guarantee that the electronic module is tamperproof. In particular, after programming has been completed, the keypad is protected by folding down a visor which solicits switch 116 via arrangement 98', then the assembly is sealed. If access is desired, switch 116 will have to be deliberately actuated.

Figure 4:
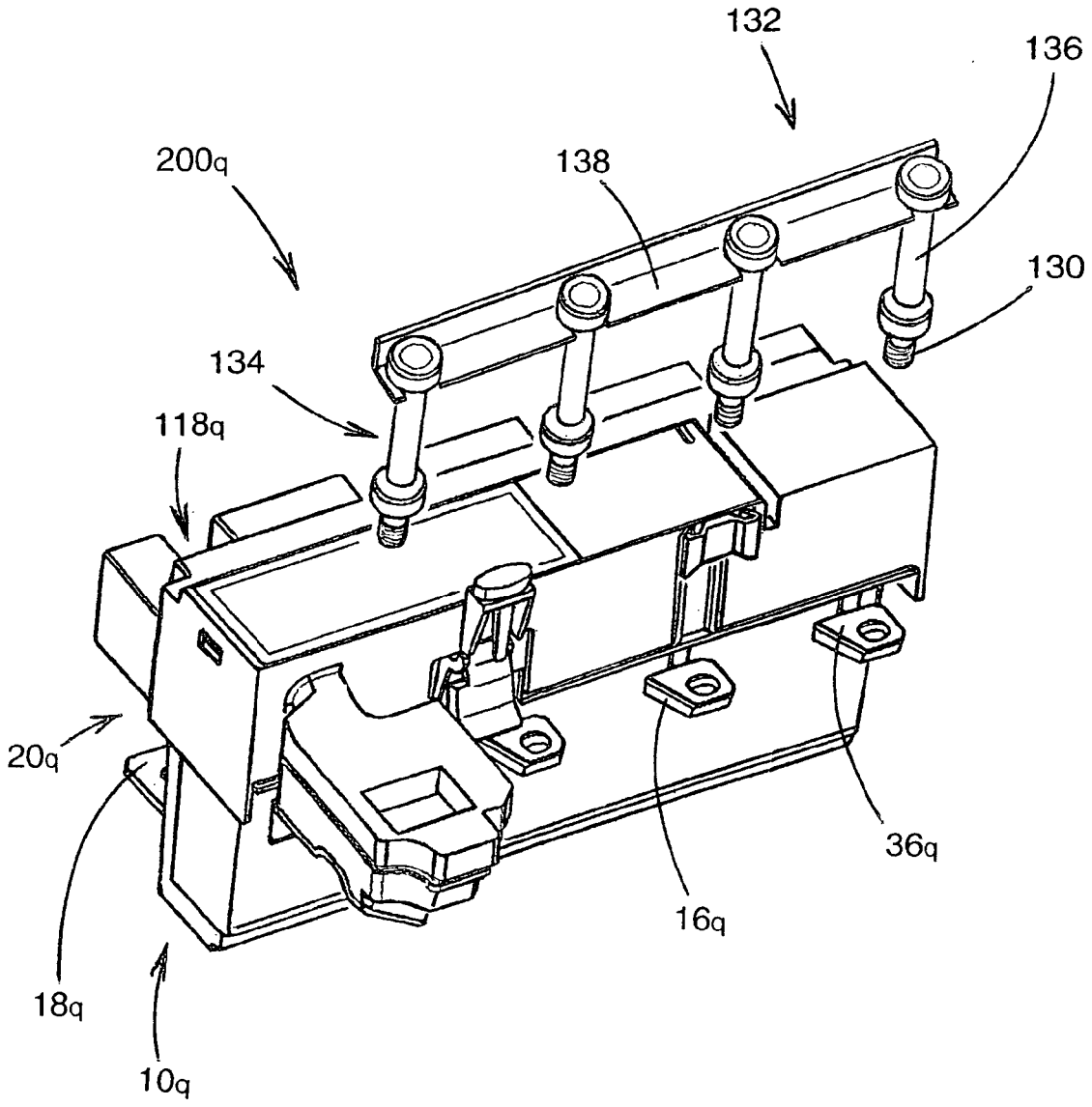
FIG. 4 illustrates another embodiment of a trip device according to the invention, as well as the assembly method by separate comb.

Three-pole trip device 200 according to the invention, also illustrated in FIG. 4 in its four-pole version 200*q*, is therefore compact, preferably L-shaped on its top part but parallelepipedic on its bottom part. A side panel of bottom part 10, 10*q* (transformer unit) of trip device 200, 200*q* presents three or four contact strips 18, 18*q* facing recesses 118, 118*q* of electronic module case 20, 20*q* and designed for connection of circuit breaker 1. The opposite side panel, integrated in the case of circuit breaker 1, also comprises three or four current inputs 16, 16*q* advantageously associated with current input strips 36, 36*q*, designed for connection with switchgear unit 3 of circuit breaker 1.

When assembly is performed, the holes of connecting strips 16, 16*q* of trip device 200, 200*q* and of switchgear unit 3 are placed facing one another and secured to one another by means of a rod-type element 130. To simplify and speed-up assembly of these two components, trip device 200*q* according to the invention is advantageously provided with a connecting comb 132. As illustrated in FIG. 4, the four connecting rods 130 form part of breakable screws 134, for example of the type described in the documents FR 2 881 485 or FR 2 840 373, the top end 136 whereof is coupled to a longitudinal bar 138. The comb 132 formed in this way comprises an alignment of screws 134 which can be directly positioned in the connecting holes. Each screw 134 is tightened and shearing of a specific section of screws 134 takes place when the tightening torque is the sufficient. Bottom part 130 of screws 134 performs connection and insulation, whereas end 136 remains coupled on bar 138. Once assembly of trip device 200*q* in the circuit breaker has been completed, the residual comb 132 simply has to be recovered. This option further prevents small parts from being lost in electrical distribution cabinets. The alignment bar 138 of screws 134 can be integrated in trip device cover 24, the additional parts 136, 138 then being able to be recovered or not after connecting rods 130 have been separated.

The invention therefore proposes an optimised architecture for an electronic trip device 200 which can replace existing trip devices while at the same time providing a wide range of functionalities, and also proposes a simplified assembly method of such a trip device. Due to the solutions chosen according to the invention, a compact electronic control and communication trip device 200 can be integrated in a predefined small volume 4, while at the same time being able to comply with the following specifications:

- the same architecture can be used for the whole range of trip devices 200, i.e. in particular for circuit breakers 1 operating from 16 to 630 A;
- interfacing of printed circuit boards 64, 70, 74 and of their electrical connections 66 enables multiple functions to be integrated in a set environmental space;
- voltage measurement is integrated in the existing volume by breaking case 20 down into electronic sub-assemblies;
- the voltage and current values are taken from the outside to the inside of the electronic assembly; they are processed in complete safety by users by integration of a transformer and a board 74 reducing their intensity;
- for three-pole units, a neutral voltage tap 42 is integrated enabling the true values of the installation neutral to be measured;
- the electromagnetic tripping function 50 is integrated in the space 20 dedicated to the electronics, by means of a hermetic sheath 58 and of the density of the other functions, so as to increase its reactivity;
- a removable read-out display module 106 is integrated in the existing environmental space, which enables the profile implemented in the switching panel to be respected without any protruding forms;
- the connectors and customer connections 72 are integrated in trip device 200, even for low ratings;
- a control device 40 for an auxiliary of safety function type is integrated;
- remote communication means 90 with a remote module are provided for all ratings;
- easy assembly between the different component elements making up trip device 200 is provided, some steps of which assembly are reversible, preferably without screws that may be lost and/or insufficiently tightened;
- a system 132 supporting connecting screws 134 for the customer is provided to guarantee a precise tightening torque of trip device 200 in circuit breaker 1 while enabling the breakable parts to be recovered.

Trip device 200 according to the invention can furthermore be 100% tested for all its functions, including as far as the quality of the welds is concerned (checking establishment of connections), even once assembled. A voltage and current input on each phase 18 of the electronic module, for example by means of gripper contacts, can be detected by means of test connector 96' on the front panel. In spite of the compactness of the assembly, this tap connector 96' can comprise up to fourteen test points, compared with the usual seven points accessible to the customer. The different tests and calibrations can be performed at the end of the assembly line, preserving the internal tightness of the assembly, all the connections to be made with the test means being external to case 20 of trip device 200. Furthermore, optic connection 90 can also be checked.

Although the invention has been described with reference to an electronic tripping system of an electrical switchgear unit, it is not limited thereto. Other elements can be concerned by the invention. In particular, the electrical connections between several layers and at different voltage and current levels according to the invention can be found in any type of apparatus.

The invention claimed is:

1. A case for an electronic module for a trip device of a switchgear unit, said trip device comprising connecting strips for operating in conjunction with a switchgear unit, wherein the case comprises:

a bottom part presenting a first surface and first side panels, and a cover presenting a second surface having through-holes for operation of an electronic module and second end panels forming a second cavity in which the bottom part can be fitted, the bottom part and the cover cooperating to form a first cavity for tightly housing a printed circuit board in a direction parallel to the second surface;

a sheath within the first cavity defines a connecting passage that passes through at least one of said first side panels of the bottom part and an actuation hole through at least one of said first side panels of the bottom part for facing connecting strips of the trip device, the cover including a hollow passage facing said actuation hole, the sheath for tightly housing an actuator with respect to said first cavity, said actuator able to take a first rest position inside the case and a second active position wherein it is protruding from the case via said hole and said recess in the cover.

2. The case according to claim 1 wherein the cover is securedly affixed to the bottom part by clipping.

3. The case according to claim 1 wherein the bottom part comprises a bottom and a double bottom fixedly secured to one another thereby defining a space.

4. The case according to claim 3 wherein the space between the bottom and the double bottom houses a pusher device able to slide therein.

5. The case according to claim 3 wherein the space between the bottom and the double bottom houses conductors extending between a first connecting strip extending from said space for connecting to a connecting strip of a trip device, and a second connecting strip located in the space between the bottom and the double bottom, the bottom including means for accessing the second connecting strip of the conductors.

6. The case according to claim 3 for a trip device of a three-phase switchgear unit wherein the space between the bottom and the double bottom houses three conductors extending between a first connecting extending from said space for connection to each connecting strip of a trip device, and a second connecting strip located in the space between the bottom and the double bottom; a neutral conductor that extends from said space via connecting means, the bottom including means for accessing the second connecting strip of each of the three conductors and a second connecting strip of the neutral conductor.

7. The case according to claim 3 wherein the bottom and the double bottom are welded.

8. The case according to claim 1 further comprising adjustment means for operating in conjunction with through-holes of the second surface and a test connector on the second surface of the cover and/or display means fitted in a recess of the second surface of the cover.

9. An electronic module of a trip device of a switchgear unit having a case according to claim 1 and an actuator fitted in the sheath, the actuator being associated with a connector passing through the passage of the sheath.

10. The electronic module according to claim 9 further comprising a main printed circuit board located in the cavity of the bottom part and connected to the actuator by its connector.

11. The electronic module according to claim 10 wherein the actuator and the main board are connected at the edge of the main board, and the connector is located between the side panels of the bottom part and of the cover.

12. The electronic module according to claim 11 further comprising at least a second printed circuit board, each second board being located between the first surface of the bottom part and the main board, and each second board communicating with the main board via at least one contact.

13. The electronic module according to claim 9 wherein the main board includes optic communication means, the case includes a passage facing the optic communication means for optic connection with another associated device.

14. The electronic module according to claim 13 wherein the case additionally comprises a support rail facing the optic passage to secure a device equipped with other optic communication means.

15. A switchgear unit comprising a case having a recess therein wherein an electronic trip device is fitted, said trip device comprising an electronic module according to claim 10 for actuating separation of at least two contacts of the switchgear unit movable with respect to one another.

16. An electronic module of a trip device comprising connecting strips for operating in conjunction with a switchgear unit, wherein the actuator is fitted into a case of the electronic module, said case comprising:

a bottom part presenting a first surface and first side panels, and a cover presenting a second surface having through-holes for operation of an electronic module and second end panels forming a second cavity in which the bottom part can be fitted, the bottom part and the cover cooperating to form a first cavity for tightly housing a printed circuit board in a direction parallel to the second surface;

a sheath within the first cavity defines a connecting passage that passes through at least one of said first side panels of the bottom part and an actuation hole through at least one of said first side panels of the bottom part for facing connecting strips of the trip device, the cover including a hollow passage facing said actuation hole;

an electromagnetic actuation device housed in the sheath, said housing being tight with respect to the first cavity, said actuation device comprising a connector passing through the passage of the sheath and a slidable push-rod which can take a first rest position inside the case and a second active position wherein it protrudes from the sheath through the actuation hole and the recess of the cover.

17. The electronic module according to claim 16 further comprising a main printed circuit board located in the cavity of the bottom part and connected to the actuator by its connector on the edge of said board, the connector being located between the side panels of the bottom part and of the cover.

18. The electronic module according to claim 17 wherein the bottom part comprises a bottom and a double bottom fixedly secured to one another and defining a space which houses conductors insulated from one another by chicanes arranged in the double bottom and extending between a first connecting extending from said space for connection to on a connecting strip of the trip device and a second connecting strip located in the space between the bottom and the double bottom, the bottom including means for accessing the second connecting strip of the conductors, the module further comprising a second printed circuit board located between the first surface of the bottom part and the main board with which said second board communicates via at least one contact, the second printed circuit board having contacts for connection with the terminal strips of the conductors.

19. The electronic module according to claim 18 wherein the second board is fitted in the cavity with a shield between the second board and the main printed circuit board.

20. The electronic module according to claim 19 additionally comprising a gold-plated piston for creating contact between the boards and/or between board and conductor.

21. The electronic module according to claim 17 wherein the main board includes optic communication means, the case having a passage facing the optic communication means for enabling optic connection with another associated device, the case additionally comprising a support rail facing the optic passage to secure a device equipped with other optic communication means.

22. The electronic module according to claim 16 further comprising a mobile striker securedly affixed to the side panel of the bottom part, facing the actuation hole, and for moving the actuator to the outside of the case.

23. A trip device of a switchgear unit comprising an electronic module according to claim 16 and a transformer unit comprising a case housing at least one conductor accessible via a first input terminal strip and a second connecting strip, the case of the electronic module being secured to the case of the transformer unit by clipping.

24. The trip device according to claim 23 associated with a connecting comb comprising a bar on which breakable connecting screws are fitted, the number of said screws corresponding to the number of input strips of the transformer unit.

25. A switchgear unit comprising a case having a recess therein, into which a trip device according to claim 23 is fitted, said trip device for actuating separation of at least two movable contacts of the switchgear unit movable with respect to one another.

26. An assembly method of an electronic trip device comprising an electronic module and a transformer unit, said method comprising a. providing a first bottom part of a case for an electronic module, comprising a cavity defined by first side panels, wherein a sheath is located and opening out via a hole in two opposite first side panels;

b. fitting an actuator into said sheath via one of the holes, a connector of said actuator passing through the other hole;

c. securing the bottom part to the case of the transformer unit;

d. positioning the main printed circuit board in the cavity of the case of the electronic module;

e. connecting the connectors of the actuator and of the transformer unit on the main board; and f. closing the cavity by a cover.

27. The assembly method according to claim 26 additionally comprising fitting actuating means for rotary components of the main board in holes of the cover.

28. The assembly method according to claim 27 wherein any of fitting the bottom part on the transformer unit, closing of the cavity by the cover, and/or fitting actuating means of rotary components, are performed by clipping.

29. The assembly method according to claim 26 wherein the bottom part of the case is formed by welding together a bottom and a double bottom, the bottom and double bottom defining a cavity into which components are fitted.

* * * * *